United States Patent [19]

Bordon

[11] Patent Number: 4,648,471

[45] **Date of Patent: * Mar. 10, 1987**

[54] CONTROL SYSTEM FOR BOREHOLE TOOLS

[75] Inventor: Ernesto E. Bordon, Houston, Tex.

[73] Assignee: Schlumberger Technology Corporation, Houston, Tex.

[ * ] Notice: The portion of the term of this patent subsequent to Jul. 9, 2002 has been disclaimed.

[21] Appl. No.: 548,109

[22] Filed: Nov. 2, 1983

[51] Int. Cl.[4] ..... E21B 43/116

[52] U.S. Cl. ..... 175/4.55; 166/55.1; 166/65.1

[58] Field of Search ..... 166/65 R, 66, 72, 113, 166/55, 55.1, 250, 297, 299, 385; 175/4.51, 4.54, 4.55, 4.56

[56] References Cited

U.S. PATENT DOCUMENTS

| | | | |
|---|---|---|---|
| 3,706,344 | 12/1972 | Vann | 166/297 |
| 3,776,323 | 12/1973 | Spidell et al. | 175/4.51 |
| 3,976,347 | 8/1976 | Cooke, Sr. et al. | 166/65 R |
| 4,113,016 | 9/1978 | Trott | 166/55.1 |
| 4,349,072 | 9/1982 | Escaron et al. | 166/65 R |
| 4,375,834 | 3/1983 | Trott | 175/4.51 |
| 4,454,814 | 6/1984 | Henry et al. | 175/4.55 |
| 4,484,639 | 11/1984 | Ayers | 166/297 |
| 4,496,010 | 1/1985 | Chapman, III | 175/4.55 |
| 4,527,636 | 7/1985 | Bordon | 166/296 |

*Primary Examiner*—Stephen J. Novosad
*Assistant Examiner*—Bruce M. Kisliuk

[57] ABSTRACT

A method and apparatus for controlling a borehole tool, which tool has been conveyed into the borehole on production tubing. Apparatus includes a downhole control module connected to the tool for actuating and/or monitoring various subassemblies and/or events within the borehole. A communications link between the control module and the surface of the borehole is achieved with a wireline which has been terminated in a manner permitting electrical connection between the wireline and the control module to be made and broken in the downhole environment. Invention therefore combines the mechanical advantages of the rigid tubing for conveying the tool with the communication advantages of the wireline.

14 Claims, 2 Drawing Figures

CONTROL SYSTEM FOR BOREHOLE TOOLS

BACKGROUND OF THE INVENTION

The present invention relates to a method and apparatus for controlling downhole tools within a borehole which tools have been conveyed into the borehole on production tubing, and more particularly for controlling a downhole perforating gun.

In order to extract hydrocarbons, both crude oil and natural gas, from earth formations it is neccessary to drill a borehole into such formations. This borehole is typically lined with a tubular steel casing in order to prevent the borehole from caving in and blocking access to the formations, as well as to prevent the uncontrolled flow of the hydrocarbons, or the intermixing of the hydrocarbons from various zones, or the contamination of these hydrocarbons with undesirable minerals or substances located within the formations surrounding the borehole. The casing is cemented to the adjacent formations surrounding the borehole to minimize any erosion of those formations which might create flow paths exterior to the casing. In order to establish communication with the producing zones of the formation, it is therefore necessary to perforate the casing and the surrounding cement to provide a path for the hydrocarbons from the formations into the well casing. This perforating is typically done with explosive charges which when actuated fire a high energy jet that passes through the casing and into the formation to create a drainage path for the hydrocarbons. Typically, one or more of these explosive charges are rigidly mounted in a predetermined pattern on a support strip, which support strip can be lowered into the borehole to a position adjacent formations which are to be perforated. Since the ambient conditions within the borehole involve extremely high temperatures and pressures (for example, 290° C. and 2000 bars pressure) it is often desirable to protect the support strip and the charges contained therein with a hollow tubular steel casing often referred to as a charge carrier. This combination, referred to as a perforating gun, can often be several meters long and weigh in the vicinity of 2500 kilograms. It is therefore not a negligible matter to convey this perforating gun into and out of the borehole. Since the perforating charges are not to be actuated until the perforating gun is positioned adjacent the formation which is to be perforated, it is also necessary that some form of communication be provided between the perforating gun and the surface of the borehole through which can actuate the charges only after the perforating gun has been accurately positioned. It has thus been customary to convey the perforating gun into and out of the borehole with a specialty cable known as wireline which is designed to afford adequate strength members to support the gun and the suspended portion of the wireline downhole, as well as communication means, such as electrical conductors or optical fibers to facilitate the necessary communication with the perforating gun in order to selectively actuate the charges contained therein. The practical mechanical limitations of such wireline, which must be adequately flexible to be wrapped around sheaves and winch drums, inherently limit the weight and length of the perforating gun which can be conveyed therewith. The use of a wireline also restricts the possibility of controlling the movement of the perforating gun other than as dictated by the pull of gravity.

An alternative conveying system known as tubing conveying has therefore been developed. Tubing conveying involves the use of multiple lengths of substantially rigid hollow steel tubing which are interconnected to convey the perforating gun or other similar borehole tools into and out of the borehole. The added mass and mechanical parameters of the hollow tubing affords the possibility of conveying heavier loads into the borehole as well as the possibility of conveying these loads in directions other than the direction of the pull of gravity. Communication with the downhole tool has however been limited to mechanical or hydraulic means such as the controlled rotation of the tubing or the controlled modulation of the fluid pressure within the tubing, etc. Guns which are tubing conveyed typically utilize mechanical means such as manually dropping an object, e.g., a metal bar, into the tubing and causing that object to strike a triggering mechanism on the gun. There are obvious disadvantages to such mechanical or hydraulic means, e.g., relative slippage between the individual joints of the tubing string, leaking joints, etc. In the case of perforating guns and bar drops, falling debris can cause an unplanned detonation, or the debris can block the triggering mechanism and prevent charge actuation. It is therefore extremely difficult with tubing conveyed equipment to reliably afford the controlled actuation of multiple events, e.g., the firing of charges, over a predetermined time period, and in a predetermined order. In addition, it has not been possible to monitor and verify the ocurrence of these events, e.g., whether the charges have been fired as planned. Without such knowledge it is possible in the example of perforating guns that unfired but yet armed charges be returned to the surface in an unexploded condition, and that zones which are thought perforated, are in fact not. The use of tubing conveying has therefore been restricted because of its inherent inability to provide an adequate communication path from the surface of the borehole to the tool contained with the borehole.

SUMMARY OF THE INVENTION

In contrast to the aforementioned shortcomings, the apparatus and method of the present invention provide a control system for downhole tools combining the greater weight capacity and directional advantages of tubing conveyed tools with the communication capabilities of wireline conveyed tools. For example, a perforating gun employing the control system according to the present invention would include a control module connected to the perforating gun which is capable of selectively actuating one or more of the charges contained within the gun. This control module is of course adapted for operation within the borehole and will therefore withstand the extreme temperature and pressures found therein. The control module is functionally connected to a connector mounted exterior to the gun and on the end of the gun which is uppermost within the borehole when the gun is inserted within the borehole. This connector is suitably designed such that connection can be made and broken within the harsh fluid environment of the borehole. A wireline is terminated with a corresponding connector. The perforating gun can be conveyed into the borehole with suitable lengths of tubing to position the perforating gun adjacent the desired formation which is to be perforated. The wireline is then lowered into the borehole inside of the tubing and connection is made with the control module of the perforating gun through the wireline. The control module can then be programmed to arm and fire the charges. The wireline can either be disconnected with the charges firing after a programmed delay, or left connected with the charges being fired directly. The wireline can also be utilized to monitor and verify various borehole and formation parameters and events including for example, whether the charges have fired or not, providing suitable sensors are connected to the control module. In addition, the control module can be utilized to control various solenoid valves or other electro-mechanical devices in order to create specialized conditions within the borehole such as under or over pressurized zones, and to actuate packers contained within the tool string and thereby isolate such zones.

DESCRIPTION OF THE ACCOMPANYING DRAWING

The present invention will be further described hereinafter with reference to the accompanying drawings wherein:

FIG. 1 is a schematic illustration of a perforating gun employing the present invention; and FIG. 2 is an functional block diagram of the control module according to the present invention.

DETAILED DESCRIPTION OF THE PRESENT INVENTION

Figure 1:
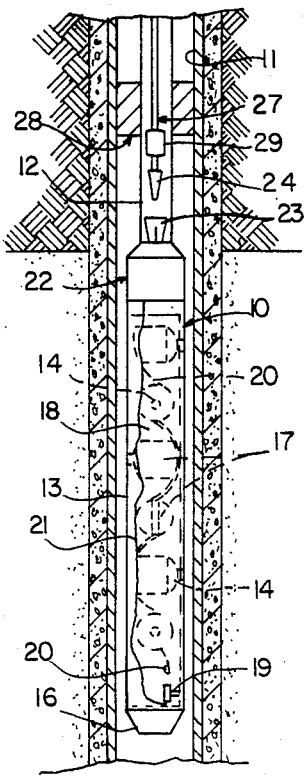

A perforating apparatus 10 incorporating the teachings of the present invention is illustrated in FIG. 1. The perforating gun 10, which is suspended in a well bore 11 by one or more lengths of tubing 12, includes a thick wall tubular housing or carrier 13 formed from steel or the like having a plurality of longitudinally spaced lateral domes 14 where the carrier 13 has been adapted to facilitate the firing of explosive charges therethrough. To provide access to the interior of the carrier 13, its lower end is closed by a removable end closure 16.

The perforating gun 10 further includes perforating means comprised of a plurality of laterally oriented shaped explosive charges 17 disposed at longitudinally spaced intervals within a corresponding support strip 18. The structure of the individual shaped charges such as utilized by the present invention is discussed in U.S. Pat. 3,773,119, which has a common assignee to that of the present invention, and the content of which is incorporated herein by reference. This explanation will not be repeated for the sake of simplicity. The support strip 18 and the charges 17 secured therein are positioned with the carrier 13 such that each of the charges 17 faces a lateral dome 14. Depending upon the desired pattern for the perforation, the shaped charges 17 could be oriented to face in the same lateral direction or to face in alternately diametrically opposed directions. Understandably, the domes 14 and the shaped charges 17 are oriented in the same pattern. The perforating gun further includes selectively operable detonating means such as an electrically responsive blasting cap 19 which is operatively positioned in the vicinity of a length of detonating cord or primer cord 20 that is also affixed to the strip 18 in detonating proximity to each of the shaped charges 17. The blasting cap 19 typically includes an igniter wire (not shown) which will heat up in response to an electrical current flowing there-through. When this igniter wire is heated, it eventually ignites a primary explosive within the blasting cap 19 which will generate enough explosive force to actuate the primar cord 20. This explosive force is transmitted along the primer cord 20 so as to initiate an explosive reaction eventually igniting the shaped charges 17.

The igniter wire is electrically connected by wire 21 to a blasting cap control assembly 40 (FIG. 2) of a control module 22 within the perforating gun 10. The control module 22 is functionally connected to a connector 23 on the uppermost end of the gun 10. This connector 23 is similar to that described in U.S. patent application Ser. No. 471,416, filed Mar. 2, 1983, which has a common assignee to the present invention, and the content of which is incorporated herein by reference. The connector 23 and it's corresponding mating connector 24 are suitably designed such that electrical connection is permitted within the fluid environment contained within the borehole 11, even if this fluid environment is saline and thus electrolytic. A wireline 27 is terminated with connector 24 and lowered into the borehole inside of the tubing 12. Typically one or more bridge plugs or packing assemblies 28 are also included in the tool string formed by the tubing 12 and the gun 10. When actuated the packing assemblies 28 or bridge plugs can impose a barrier between the casing of the well and the production tubing 12 and thereby create isolated zones which can be pressurized or depressurized during perforation to control the rate of flow of formation fluids and thus minimize the potential of debris from the perforation obstructing the flow paths. Both the packer 28 and the bridge plug (not shown) are commercially available units which are readily obtainable from a variety of sources. When electrical contact is made between connectors 23 and 24, a communication path is established from the surface of the borehole to the control module 22 of the downhole gun 10.

Figure 2:
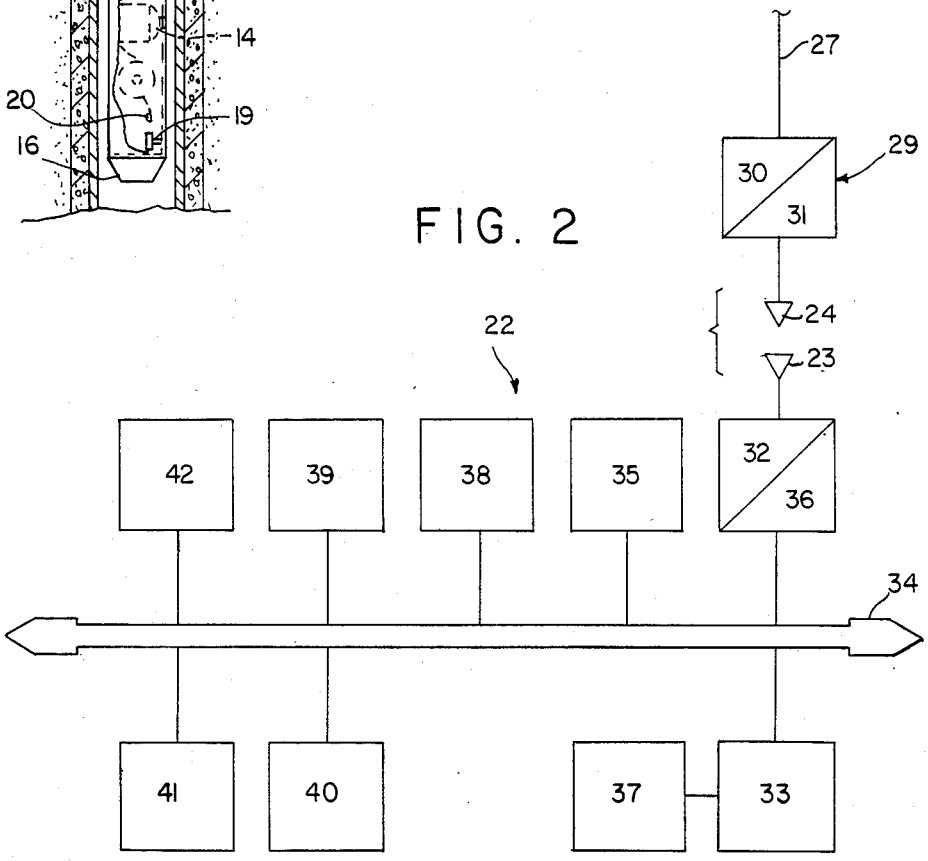

The design and operation of the control module 21 are best illustrated by reference to FIG. 2 wherein the wireline 27 is shown including a power cartridge 29. This power cartridge 29 contains a downhole power supply 30 and a serial link modern 31. Both of these are terminated by suitable electrical contacts within the wireline connector 24. Corresponding electrical contacts within connector 23 will therefore link the wireline 27 and the power cartridge 29 with the control module 22. The power supply 30 can then be used to charge a battery 32 within the control module 22 as well as to provide direct power to the other downhole circuits located therein. These downhole circuits include a microprocessor 33 which through its bus 34 communicates with RAM and/or ROM memory 35 and thereby stores instructions for controlling the various sensors and devices within the perforating gun 10. The microprocessor 33 is also linked to a serial link modern 36 which through the corresponding modern 31 in the power cartridge 29 affords communication between the surface of the borehole and the gun 10. The microprocessor 33 can therefore receive instructions and be programmed from the surface when the gun 10 is downhole in addition to being preprogrammed before the gun 10 is conveyed downhole. A clock 37 is also connected to the microprocessor 33 to control the timing of events monitored or instructed by the microprocessor 33.

As has been previously mentioned various sensors and devices can be controlled by the control module 22. These are shown in FIG. 2 in block form connected to the bus 34. Naturally suitable formatting must be included, for example, A to D converters and appropriate interfaces in order to make communications with and between such sensors and devices compatible. For the sake of clarity these interfaces and converters have not been shown and are considered to be known to the art. Thus, for example, a suitable sensor for detecting the presence of a casing collar joint is shown by block 38. This sensor would provide one means for determining the exact positioning of the gun 10 within the borehole 11. Other means for determining position are also feasible, e.g., mechanical wheels or other direct displacement measurement devices, or utilizing a gamma radiation source and detector to obtain a gamma log of the formations which can be correlated with other gamma logs in which the precise depths are known. This information can be transmitted uphole through the wireline 27 to facilitate the positioning of the gun 10.

Once the gun 10 has been accurately positioned adjacent the desired formations sensor 39 can be used to determine various conditions within the borehole 11 such as the presence of fluid, which might affect the perforation process. Standard technology sensors can be used for this purpose. If the conditions in the borehole 11 are conducive to perforation, a signal can be sent to the microprocessor 33 to actuate a blasting cap control assembly 40, which can in turn fire the shaped charges 17 (see FIG. 1). This can be done directy or the microprocessor 33 can be programmed with a delay to enable the wireline 27 to be disconnected prior to perforating. The connectors 23 and 24 are designed to facilitate this disconnection and reconnection. The microprocessor 33 can also be used to actuate packers 28 (FIG. 1) or bridge plugs through a solenoid control assembly 41. As has already been discussed these packers 28 and plugs will isolate zones within the casing 11 which can be pressurized to a predetermined pressure in order to prevent any blockage of the flow paths by debris created by the perforation. A pressure sensor 42 can sense the pressure conditions during and after perforation and thereby provide an indication of the flow conditions resulting from the perforation. From this information the efficacy of the perforations, i.e. whether the charges have fired, can be determined. Such control assemblies and sensors are commercially available and will not be described. The serial link modems 31 and 36 can transmit any of this data provided by the sensors and control assemblies uphole or transmit additional instructions downhole as is required.

It can therefore be seen that the control system of the present invention affords the use of downhole tools which due to their weight or length must be tubing conveyed and which have previously not been fully utilized because of the inability to provide adequate communication between the surface of the borehole and the downhole tool. Having thus described a preferred embodiment of the present invention, it will be understood that changes can be made in the size, shape, or configurations of some of the components without departing from the present invention as described in the appended claims.

I claim:

1. A control assembly for use with a tool including one or more subassemblies adapted for controlling and/or monitoring various events within a borehole and actuating instrumentation positioned on the earth's surface for actuating said tool, comprising:

control means connected to the tool for selectively actuating one or more of the subassemblies within the tool, said control means being adapted for operation within the borehole, power supply means connected to the tool for supplying electrical power to said control means for operation thereof independent of the surface actuating instrumentation, communication means connected to the surface actuating instrumentation for communicating therewith, and connection means for selectively connecting said communication means to said control means while the tool and said control means connected thereto are within the borehole to establish communication between said control means and the surface actuating instrumentation, said connection means being adapted for operation within the borehole.

2. A control assembly as claimed in claim 1 wherein said control means includes means for progamming a delayed actuation of the subassemblies.

3. A control assembly as claimed in claim 1 wherein said control means includes means for actuating the subassemblies in response to a signal from the surface actuating instrumentation.

4. A control assembly as claimed in claim 1 wherein said connection means include a first connector mounted to said communication means and a second connector mounted to said control means which are adapted for mating and establishing electrical connection in a fluid environment.

5. A control assembly as claimed in claim 1 wherein said tool is a perforating gun and one of said subassemblies includes means for actuating one or more explosive charges within said gun.

6. A tool string for completing a cased borehole having electrical instrumentation at the earth's surface associated therewith, comprising:

at least one perforating gun including a pluality of explosive charges for penetrating the casing and the formations surrounding the borehole, and support means for supporting and positioning said charges in a predetermined pattern within said gun, means for conveying said gun to a predetermined depth within said borehole, control means connected to said gun for selectively actuating one or more of said charges, said control means being adapted for operation within the borehole, said control means including power supply means for supplying power for operation of said control means independent of said surface instrumentation, communication means connected to said surface instrumentation for communicating with said control means from said surface instrumentation when said gun and said control means connected thereto are within the borehole, and connection means for selectively connecting said communication means to said control means, said connection means being adapted for operation with the borehole.

7. A tool string as claimed in claim 6 wherein said control means includes means for programming a delayed actuation of said charges.

8. A tool string as claimed in claim 6 wherein said control means includes means for actuating said charges in response to a signal from the surface instrumentation.

9. A tool string as claimed in claim 6 wherein said tool string includes a plurality of subassemblies and control means includes means for actuating one or more of said subassemblies within the tool string.

10. A tool string as claimed in claim 6 wherein said control means includes means to detect the firing of said charges.

11. A tool string as claimed in claim 6 wherein said connection means include a first connector mounted to said communication means and a second connector mounted to said control means which are adapted for mating and establishing electrical connection in a fluid environment.

12. A control system for a perforating gun which includes a plurality of explosive charges and means for detonating said charges, said gun being positionable in a borehole having instrumentation associated therewith located remote from said borehole, comprising:

control means connected to said gun including:

a. actuating means for actuating said detonating means in response to signals received thereby, b. sensor means for sensing conditions in said borehole and producing output signals indicative thereof, c. memory means for receiving and storing said output signals from said sensor means, d. power supply means for supplying electrical power to said sensor means and said memory means, and e. signal processing means for receiving signals from said sensor means and memory means and transmitting output signals to said actuating means in response thereto; and means lowerable into said borehole for connection with said control means for establishing electrical communication between said control means and said remote instrumentation.

13. The system of claim 12, wherein said memory means further includes means for storing predetermined instructions for the operation of said actuating means.

14. The system of claim 12, wherein said downhole signal processing means actuates said sensor means to sense conditions in said borehole absent said lowerable communication means and to output said output signals to said memory means.

* * * * *